US008144913B1

(12) United States Patent
Myles, Jr.

(10) Patent No.: US 8,144,913 B1
(45) Date of Patent: Mar. 27, 2012

(54) TRAVEL PILLOW WITH AUDIO SYSTEM

(76) Inventor: Robert L. Myles, Jr., Las Vegas, NV (US)

( * ) Notice: Subject to any disclaimer, the term of this patent is extended or adjusted under 35 U.S.C. 154(b) by 1069 days.

(21) Appl. No.: 12/018,396

(22) Filed: Jan. 23, 2008

Related U.S. Application Data

(60) Provisional application No. 60/886,264, filed on Jan. 23, 2007.

(51) Int. Cl.
*H04R 25/00* (2006.01)

(52) U.S. Cl. ..... 381/374; 381/333; 381/334; 381/385; 381/388

(58) Field of Classification Search ..... 381/388, 381/333–334, 307, 374, 376; 5/639
See application file for complete search history.

(56) References Cited

U.S. PATENT DOCUMENTS 6,289,538 B1 * 9/2001 Fidge ..... 5/640
7,227,965 B1 * 6/2007 Sutton ..... 381/124
2007/0253581 A1 * 11/2007 Sutton ..... 381/124

* cited by examiner

*Primary Examiner* — Ramon Barrera
(74) *Attorney, Agent, or Firm* — Greenberg Traurig

(57) ABSTRACT

Described is a traveling pillow having embedded headphones for providing a traveler with a comfortable place for resting the neck and head and music to the ears. A universal plug can be located within a pocket of the pillow to permit connection to the headphones and a location for storing an MP3 player, iPod® or cellular phone with music files. Alternatively, a separate plug is provided and accessible from the exterior of the pillow should the traveler desires to use an audio cord and place the music storage device elsewhere, or to connect a Walkman®, Discman®, laptop or DVD player to the pillow headphones. A volume control knob permits the traveler to set an appropriate volume level to provide his or her favorite music in surround sound and total comfort.

20 Claims, 3 Drawing Sheets

TRAVEL PILLOW WITH AUDIO SYSTEM

CROSS REFERENCE TO RELATED APPLICATIONS

This application claims the benefit of U.S. Provisional Patent Application No. 60/886,264 filed Jan. 23, 2007.

FIELD OF THE INVENTION

The embodiments of the present invention relate to pillows, more specifically, to an acoustical travel pillow adapted to supporting a user's head and neck and providing auditory enjoyment at the same time.

BACKGROUND

Public transportation vehicles, whether trains, planes, automobiles or intra-city busses, all require passengers to occupy their seats for extended periods of time. Except for the very fortunate few, passenger seating is arranged to efficiently pack as many people together, over as small an area, as possible. While this may bring travel costs down, such tight packing can make long periods of time excruciatingly uncomfortable as well as tedious for travelers. Attempting to relax in such an environment risks sleep. This in turn, without neck support, results in a stiff neck and cramped shoulder muscles upon awakening.

Many travelers resort to travel pillows to provide a stable support for the neck. These pillows are typically small, often having a foam core with a fabric cover. Some are U-shaped to receive the neck and head in an upright manner. Others are L-shaped to provide enhanced support for the neck and side of the face. While permitting the user to relax and rest while sitting in an up-right position, traveling can be somewhat chaotic, and a need exists to provide a resting traveler with the ability to sonically escape without interfering with the peace and enjoyment of travelers located literally inches away.

SUMMARY

Accordingly, a first embodiment of the present invention discloses a travel pillow comprising: a body; a pocket disposed about said body, said pocket configured to house an electronic device; and a pair of ear bud headphones disposed about said body, said headphones operable to output an audio signal from said electronic device. The electronic device includes MP3 player, iPod, cellular phone, Walkman, Discman, laptop and DVD player. A volume control knob can be disposed about said body for controlling the volume of said audio signal. The pillow further includes fastening means for securing said electronic device to said pocket, said fastening means including zippers, Velcro, hook and loop fastening strips and other suitable fasteners. Compartments may be disposed about said body, said compartments configured to store said headphones with flaps for securing said compartments.

A second embodiment of the present invention discloses a travel pillow comprising: a body; an audio jack disposed about said body, said audio jack operable to receive an audio signal from an electronic device; and a pair of ear bud headphones coupled to said audio jack, said headphones operable to output said audio signal from said electronic device. The electronic device includes MP3 player, iPod, cellular phone, Walkman, Discman, laptop and DVD player. A volume control knob can be disposed about said body for controlling the volume of said audio signal. Compartments may be disposed about said body, said compartments configured to store said headphones with flaps for securing said compartments.

A third embodiment of the present invention discloses a travel pillow comprising: a body; a pocket disposed about said body, said pocket configured to house a first electronic device capable of outputting a first audio signal; an audio jack disposed about said body, said audio jack operable to receive a second audio signal from a second electronic device; and a pair of ear bud headphones disposed about said body, said headphones operable to output said first audio signal from said first electronic device or said second audio signal from said second electronic device. The electronic devices include MP3 player, iPod, cellular phone, Walkman, Discman, laptop and DVD player. A volume control knob can be disposed about said body for controlling the volume of said audio signal. The pillow further includes fastening means for securing said first electronic device to said pocket, said fastening means including zippers, Velcro, hook and loop fastening strips and other suitable fasteners. Compartments may be disposed about said body, said compartments configured to store said headphones with flaps for securing said compartments. In addition, an audio splitter may be disposed within said body, said audio splitter configured to switch between said first audio signal from said first electronic device and said second audio signal from said second electronic device.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
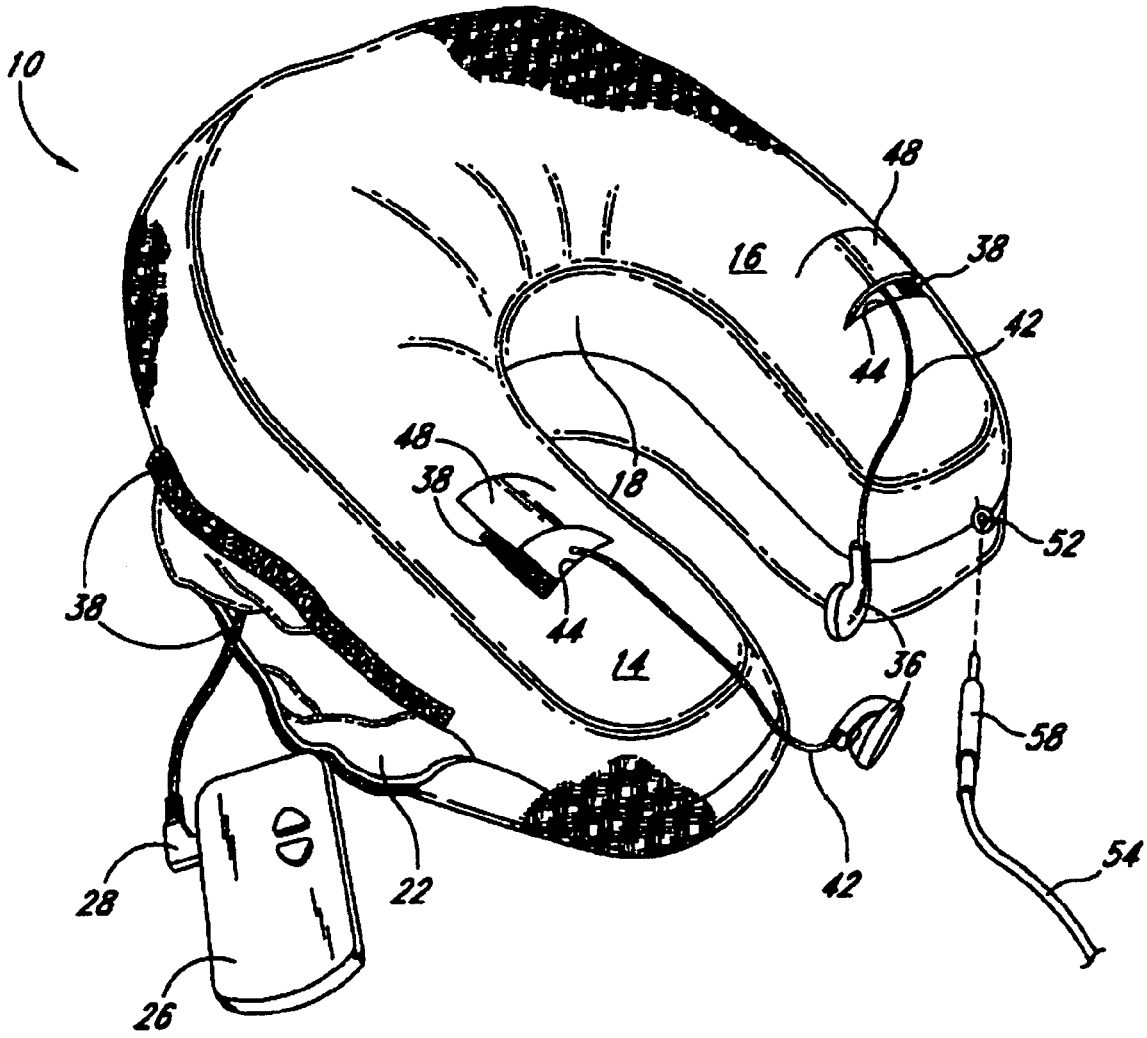
FIG. 1 illustrates a perspective view of a travel pillow according to the presently disclosed invention.

Reference is made to FIG. 1 illustrating a perspective view of a travel pillow 10 according to a first embodiment of the presently disclosed invention. As shown, the pillow 10 has a generally U-shape with a left arm 14 and a right arm 16 collectively forming a notch 18 for receiving a user's neck and head. In other embodiments, the pillow 10 can take on other polygonal shapes including L-shape, square or rectangular.

A pocket 22 can be formed in the left arm 14 and suitably sized to receive an electronic or music storage device 26 including an MP3 player, Apple iPod® or cellular phone with music files. The pocket 22 can also be sized to receive electronic devices 26 capable of streaming live audio and/or video feeds. In one embodiment, the pillow pocket 22 measures approximately 3×5 inches, which sufficiently accommodates the majority of music storage devices 26 in use today. In other embodiments, the pillow pocket 22 can be as large or as small as desired. Although shown to be disposed on the left arm 14, it will be appreciated by one skilled in the art that the pocket 22 can also be formed on the right arm 16 or other parts of the pillow 10. In other embodiments, multiple pockets 22 may be formed on either the left arm 14, right arm 16 or both arms 14, 16 of the travel pillow 10 for housing multiple electronic devices 26 with music files. The pockets 22 may also be used to store other objects including PDA's and Blackberries.

A connector 28 can be disposed within the pillow pocket 22 to electrically couple the music storage device 26 to a pair of ear bud headphones 36 via lines 42 (see FIG. 2) within the interior of the travel pillow 10. This will become more apparent in subsequent figure and discussion. In one embodiment, each ear bud headphone 36 is housed within a storage area or compartment 44, which is disposed on both the left arm 14 and right arm 16 of the travel pillow 10 as shown in FIG. 1. It is understood that the headphones 36 can also be housed within a single compartment 44 between the left and right arms 14, 16 of the pillow 10. In other embodiments, the compartments 44 can be disposed elsewhere on the left and right arms 14, 16 in addition to the locations shown in FIG. 1. Once coupled, the ear bud headphones 36 can receive audio signals from the music storage device 26, though the lines 42, and output the corresponding audio signals as audio and music to a user's ear should the person be wearing the ear bud headphones 36. In other embodiments, speakers (not shown) may be incorporated in place of headphones 36. It will be appreciated by one skilled in the art that the operations of the music storage device 26 are commonly known and will not be discussed in further detail.

A pair of hook and loop fastening strips 38 adjacent the pillow pocket 22 may be selectively used for opening and closing the pillow pocket 22 thereby retaining the music storage device 26 therein. Likewise, cover flaps 48 with associated hook and loop fasteners may be utilized for opening and closing of the compartments 44 similar to that of the hook and loop fastening strips 38. In other embodiments, zippers, Velcro, and other suitable fastening means may be utilized to secure the music storage device 26 within the pocket 22 or the ear bud headphones 36 within the compartments 44. In some instances, the fasteners 38 and flaps 48 may not be necessary.

In another embodiment, an audio input or jack 52 can be disposed about the exterior surface of the right arm 16 of the travel pillow 10 as shown in FIG. 1. The audio jack 52 allows a user to plug in an external source (not shown) of musical signals, which can be sent over an audio cable 54 and connected to the audio jack 52 in a conventional manner via an audio plug 58. In this instance, the audio jack 52 can be electrically coupled to the headphones 36. Like the previous embodiments, once coupled, the ear bud headphones 36 are capable of receiving audio signals from the external acoustical device and output the corresponding audio signals as audio and music to a user's ear. It will be understood by one skilled in the art that the input jack 52 can also be disposed about the left arm 14 of the travel pillow 10.

The interior portions of the travel pillow 10 may utilize any various conventional filler material to maintain the exterior shape and user comfort/support. In one embodiment, a foam rubber material is incorporated. In other embodiments, flexible polymeric materials and plastics may be utilized. The exterior surface of the travel pillow 10 can be fabricated of cloth, leather or other suitable material. In one embodiment, the travel pillow 10 can be constructed of an outer shell consisting of 100% polyester and filled with materials including cotton and/or polyester. The resulting product can be provided in several different sizes. For example, the travel pillow 10 can be 12 inches long, 12.5 inches wide, and 4.5 inches thick with a total outer circumference of approximately 36 inches.

Figure 2:
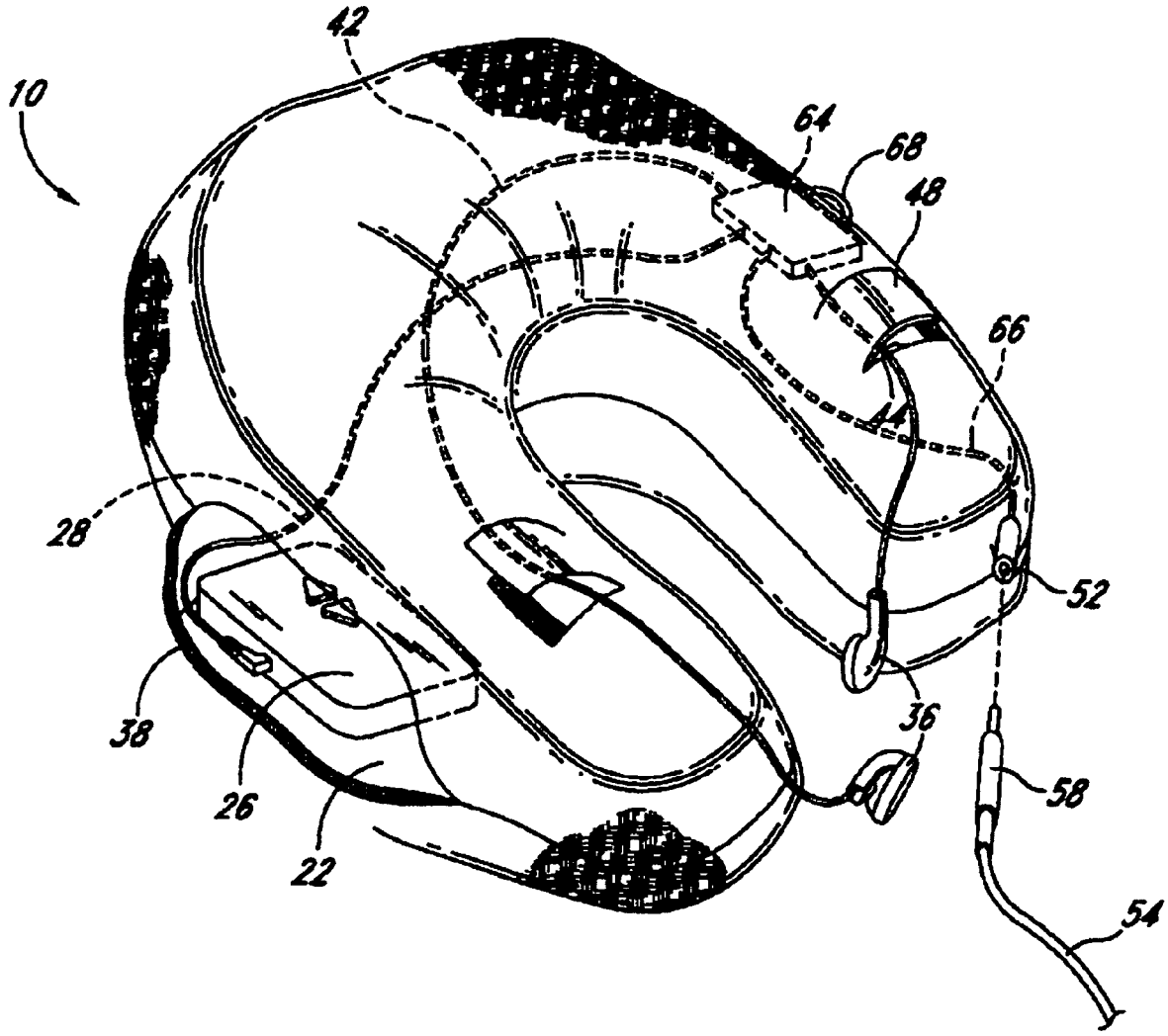
FIG. 2 illustrates a perspective view of the travel pillow of FIG. 1 with portions in phantom.

Reference is now made to FIG. 2 illustrating a perspective view of the travel pillow 10 of FIG. 1 with portions in phantom for illustrating a plurality of electrical lines 42, 66 running throughout the interior of the travel pillow 10. As shown in FIG. 2, an audio splitter 64 can be used to receive electrical signals from the music storage device 26 through the connector 28, or the audio jack 52 through an audio line 66. The audio splitter 64 subsequently splits the electrical signal to energize each of the ear bud headphones 36. In one embodiment, a toggle switch (not shown) may be disposed about an exterior surface of the right arm 16 to facilitate switching of audio signal from the two different inputs. In others words, a user can toggle between receiving audio signals from the music storage device 26 housed within the pillow pocket 22 or the audio signals from the external device (not shown) via the jack 52 and plug 58. A volume control knob 68 can be disposed about the exterior surface of the travel pillow 10 to permit user access and control of the volume of the audio signals being output by the headphones 36, whether from the music storage device 26 or the external device. In one embodiment, the audio splitter 64 and the volume control knob 68 can be integrated as a single electronic unit. It is understood that additional electronic components and circuits including batteries may be incorporated in operating the audio splitter 64 and volume control knob 68 as necessary.

Figure 3:
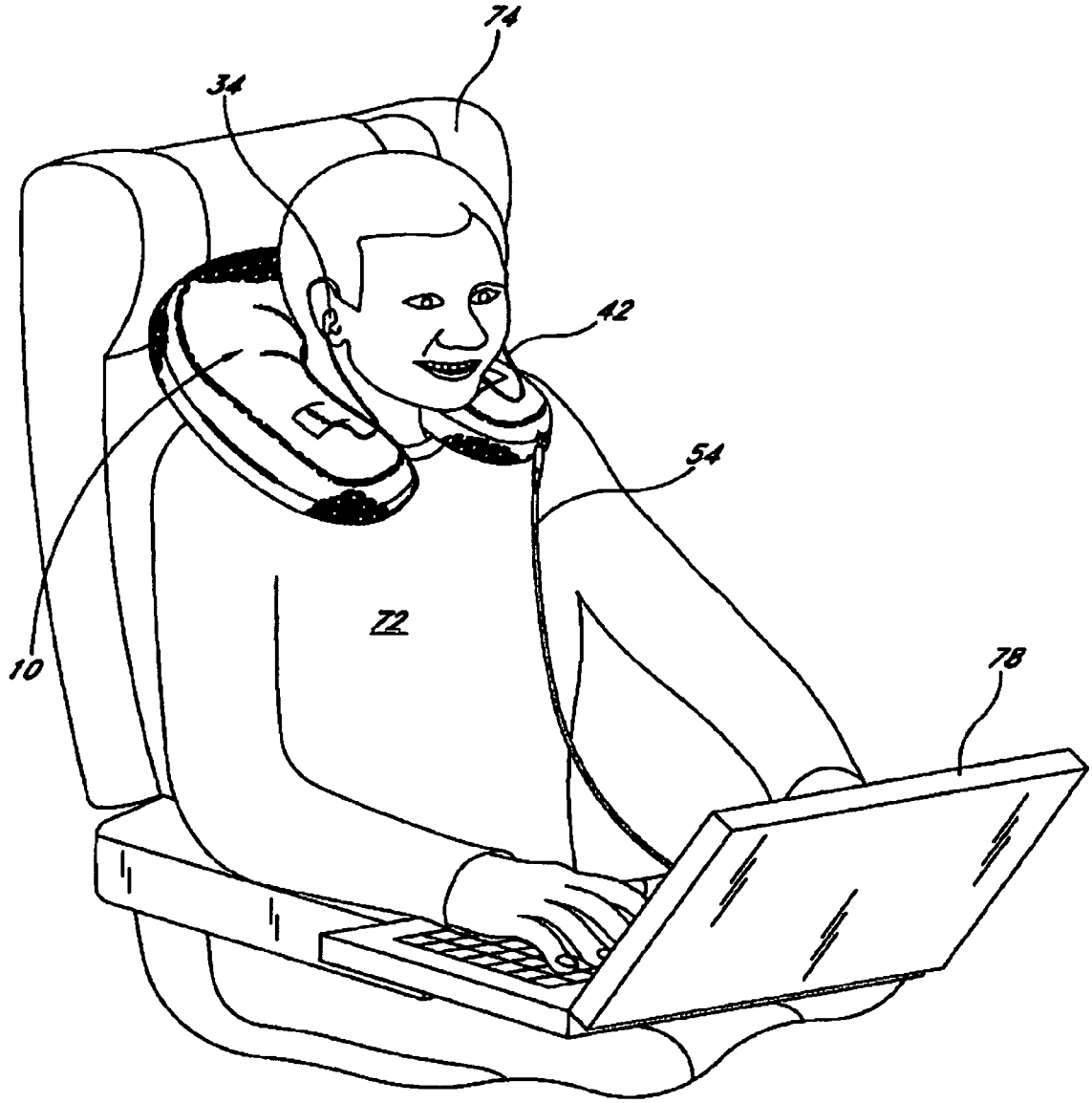
FIG. 3 illustrates a perspective view of the travel pillow in operation.

Reference is now made to FIG. 3 illustrating a perspective view of the travel pillow 10 in operation. As shown, a user 72 is positioned against a passenger seat 74 with the head and neck of the user 72 being received within the notch 18 of the travel pillow 10. In operation, the user 72 can place the music storage device 26 within the pillow pocket 22 and coupled to the input connector 28. Once connected, audio signals from the device 26 including the likes of a CD playing or a music file playing can be received and output to the ear bud headphones 36, which can be placed in or adjacent the ear of the user 72. In another mode of operation, audio signals can be transmitted from a laptop 78, via an audio cable 54 and plug 58 into the audio jack 52, and output through the ear bud headphones 36 in a similar fashion as that before. In this instance, the audio signals from the laptop 78 can come from a streaming movie, news broadcast or music file. In one embodiment, the audio jack 52 may not be necessary and the audio input only comes from the electronic device 26 via input connector 28. In another embodiment, the input connector 28 may not be necessary and the audio input only comes from the laptop 78 via audio cable 54 and plug 58. In yet another embodiment, both input receivers 28, 52 can be utilized wherein the user 72 can switch between the two using the toggle switch as previously described. Furthermore, volume control can be exercised for these embodiments via the volume control knob 68. Accordingly, the travel pillow 10 is capable of providing a user 72 with head and neck support, as well as the convenience of acoustical enjoyment in an easily transported package.

Although the invention has been described in detail with reference to several embodiments, additional variations and modifications exist within the scope and spirit of the invention as described and defined in the following claims.

What is claimed is:

1. A travel pillow comprising:

a body;

a pocket disposed about said body, said pocket configured to house an electronic device;

a pair of ear bud headphones disposed about said body, said headphones operable to output an audio signal from said electronic device; and a connector extending internally within said body connecting said ear bud headphones to said electronic device, ends of said connector extending from said body via spaced openings such that said ear bud headphones are positioned for use with opposite ears of a user.

2. The pillow of claim 1, further comprising a volume control knob disposed about said body for controlling the volume of said audio signal.

3. The pillow of claim 1, further comprising fastening means for securing said electronic device to said pocket.

4. The pillow of claim 3, wherein said fastening means include zippers, Velcro, hook and loop fastening strips and other suitable fasteners.

5. The pillow of claim 1, further comprising compartments disposed about said body, said compartments configured to store said headphones.

6. The pillow of claim 5, further comprising flaps for securing said compartments.

7. The pillow of claim 1, wherein said electronic device includes MP3 player, iPod, cellular phone, Walkman, Discman, laptop and DVD player.

8. A travel pillow comprising:

a body;

an audio jack disposed about said body, said audio jack operable to receive an audio signal from an electronic device;

a pair of ear bud headphones coupled to said audio jack, said headphones operable to output said audio signal from said electronic device; and a connector extending internally within said body connecting said ear bud headphones to said electronic device, ends of said connector extending from said body via spaced openings such that said ear bud headphones are positioned for use with opposite ears of a user.

9. The pillow of claim 8, further comprising a volume control knob disposed about said body for controlling the volume of said audio signal.

10. The pillow of claim 8, further comprising compartments disposed about said body, said compartments configured to store said headphones.

11. The pillow of claim 10, further comprising flaps for securing said headphones within said compartments.

12. The pillow of claim 8, wherein said electronic device includes MP3 player, iPod, cellular phone, Walkman, Discman, laptop and DVD player.

13. A travel pillow comprising:

a body;

a pocket disposed about said body, said pocket configured to house a first electronic device capable of outputting a first audio signal;

an audio jack disposed about said body, said audio jack operable to receive a second audio signal from a second electronic device; and a pair of ear bud headphones disposed about said body, said headphones operable to output said first audio signal from said first electronic device or said second audio signal from said second electronic device.

14. The pillow of claim 13, further comprising a volume control knob disposed about said body for controlling the volume of said first and second audio signals.

15. The pillow of claim 13, further comprising fastening means for securing said first electronic device to said pocket.

16. The pillow of claim 15, wherein said fastening means include zippers, Velcro, hook and loop fastening strips and other suitable fasteners.

17. The pillow of claim 13, further comprising compartments disposed about said body, said compartments configured to store said headphones.

18. The pillow of claim 17, further comprising flaps for securing said headphones within said compartments.

19. The pillow of claim 13, further comprising an audio splitter disposed within said body, said audio splitter configured to switch between said first audio signal from said first electronic device and said second audio signal from said second electronic device.

20. The pillow of claim 13, wherein said first and second electronic devices include MP3 player, iPod, cellular phone, Walkman, Discman, laptop and DVD player.

* * * * *